US005769286A

United States Patent [19]

Conti

[11] Patent Number: 5,769,286

[45] Date of Patent: Jun. 23, 1998

[54] HOSIERY ITEM SPREADING UNIT WITH PNEUMATIC FEED, USABLE WITH PNEUMATIC HOSIERY ITEM CONVENIENCE SYSTEMS EQUIPPED WITH A CENTRALIZED SUCTION

[75] Inventor: Stefano Conti, Milan, Italy

[73] Assignee: Essedue S.r.l., Milan, Italy

[21] Appl. No.: 816,184

[22] Filed: Mar. 12, 1997

[30] Foreign Application Priority Data

Mar. 18, 1996 [IT] Italy ..... MI96A0528

[51] Int. Cl.[6] ..... D06C 5/00; B65G 51/34; B65G 47/24

[52] U.S. Cl. ..... 223/75; 223/43; 406/13; 406/87; 406/168; 406/171; 414/755

[58] Field of Search ..... 406/21, 13, 87, 406/168, 171; 414/755; 223/1, 75, 43

[56] References Cited

U.S. PATENT DOCUMENTS

| | | | |
|---|---|---|---|
| 3,157,439 | 11/1964 | Salmona | 406/21 |
| 3,396,879 | 8/1968 | Hall | 223/43 |
| 3,844,621 | 10/1974 | Tiranou et al. | 414/755 |
| 4,099,789 | 7/1978 | Zaglio | 406/87 |
| 4,159,824 | 7/1979 | Stange et al. | 406/13 |
| 4,320,559 | 3/1982 | Couture | 406/21 |
| 5,040,475 | 8/1991 | Fournier et al. | 223/43 |
| 5,165,355 | 11/1992 | Fournier et al. | 223/43 |

*Primary Examiner*—Bibhu Mohanty
*Attorney, Agent, or Firm*—Guido Modiano; Albert Josif

[57] ABSTRACT

A hosiery item spreading unit with pneumatic feed, usable with pneumatic hosiery item conveyance systems equipped with a centralized suction, comprising: a structure which forms an elongated spreading chamber arranged with its longitudinal axis substantially horizontal and provided, at its longitudinal ends, respectively with a first opening, connected to a duct for feeding the hosiery item to be spread, and with a second opening, connected to a suction duct which can be connected to suction means; the spreading chamber being closed, in a downward region, by a door which can be opened on command to remove the spread hosiery item and containing also elements for gripping a longitudinal end of the hosiery item which are spaced from the first opening towards the second opening. The spreading unit further comprises an auxiliary duct which connects the hosiery item feed duct to the suction duct and valves which can be actuated on command selectively into first, second and third operating positions, for respectively conveying a hosiery item into the spreading chamber, spreading out and eventually allowing removal of the spread hosiery item.

15 Claims, 5 Drawing Sheets

HOSIERY ITEM SPREADING UNIT WITH PNEUMATIC FEED, USABLE WITH PNEUMATIC HOSIERY ITEM CONVENIENCE SYSTEMS EQUIPPED WITH A CENTRALIZED SUCTION

BACKGROUND OF THE INVENTION

The present invention relates to a hosiery item spreading unit with pneumatic feed, usable with pneumatic hosiery item conveyance systems equipped with a centralized suction.

Conventional spreading units spread hosiery items leaving the machine that produces them or leaving a machine for turning them right way out after the closure of the toe, performed by means of specifically-provided looping machines.

Currently commercially available spreading units are substantially constituted by a structure which forms an elongated spreading chamber arranged so that its longitudinal axis is horizontal and connected, at its longitudinal ends, respectively to a hosiery item feed duct and to an actuation duct selectively connected, through valve means, to the suction duct or to the delivery duct of a fan wherewith the spreading unit is equipped.

In practice, when the actuation duct is connected to the suction duct of the fan, a stream of air along the spreading chamber occurs conveying the hosiery item, which arrives from the production machine or from the overturning machine, into the spreading chamber, where specific means are provided for gripping a longitudinal end of the hosiery item, usually constituted by the toe of said hosiery item. After the hosiery item has been engaged in this manner, the actuation duct is connected to the delivery duct of the fan, causing a reversal of the stream of air through the spreading chamber and thus spreading the hosiery item.

The spreading chamber is generally closed in a downward region by a door which can be opened so as to release the hosiery item by gravity after it has been spread.

Conventional spreading units are rather reliable in operation, but they entail the problem that they require, for their operation, the use of an independent fan and therefore of a corresponding independent motor for the actuation of said fan.

Therefore, in large hosiery factories using simultaneously a large number of hosiery-making machines, the adoption of a spreading unit for each hosiery-making machine significantly affects the overall investment costs of the production system.

SUMMARY OF THE INVENTION

A principal aim of the present invention is to solve the above problem by providing a hosiery item spreading unit with pneumatic feed which can be used with pneumatic hosiery item conveyance systems having a centralized suction without requiring an independent motor and fan.

Within the scope of this aim, an object of the invention is to provide a spreading unit which can operate correctly simply by using the stream of air generated by a suction duct connected to a centralized suction system.

Another object of the invention is to provide a spreading unit having significantly lower production costs than currently commercially available spreading units, thus making it convenient to adopt it, even in large numbers, in large production facilities.

This aim, these objects, and others which will become apparent hereinafter are achieved by a hosiery item spreading unit with pneumatic feed, usable with pneumatic hosiery item conveyance systems equipped with a centralized suction, comprising a structure which forms an elongated spreading chamber arranged so that its longitudinal axis is substantially horizontal and provided, at its longitudinal ends, respectively with a first opening, connected to a duct for feeding the hosiery item to be spread, and with a second opening, connected to a suction duct which can be connected to suction means; said spreading chamber being closed, in a downward region, by a door which can be opened on command to remove the spread hosiery item; said spreading chamber also containing means for gripping a longitudinal end of the hosiery item which are spaced from said first opening towards said second opening; characterized in that it comprises an auxiliary duct connecting said hosiery item feed duct to said suction duct and valve means which can be actuated on command selectively into a first operating position, wherein they close said auxiliary duct, connecting said suction duct to said feed duct through said spreading chamber in order to convey a hosiery item to be spread into the spreading chamber; into a second operating position, wherein they connect said suction duct to said feed duct through said auxiliary duct and connect said second opening to the outside to reverse the suction stream through said spreading chamber with respect to the suction stream determined by said first operating position; and into a third operating position, wherein they disconnect said spreading chamber from said suction duct.

BRIEF DESCRIPTION OF THE DRAWINGS

Further characteristics and advantages of the present invention will become apparent from the following detailed description of a preferred but not exclusive embodiment of the spreading unit according to the present invention, illustrated only by way of non-limitative example in the accompanying drawings, wherein.

DESCRIPTION OF THE PREFERRED EMBODIMENTS

Figure 1:
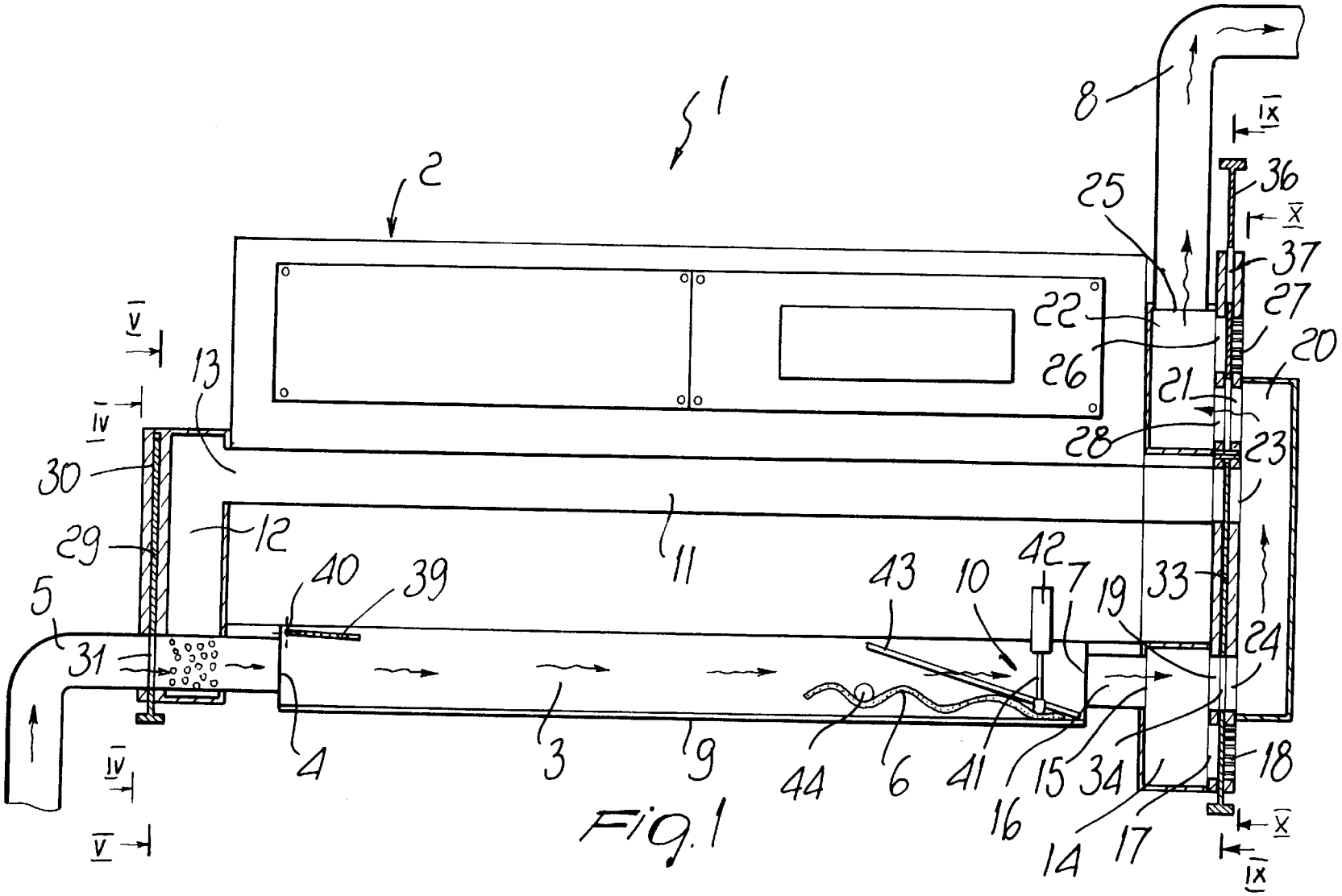
FIG. 1 is a schematic sectional view of the spreading unit according to the present invention, with the valve means in the first operating position.

With reference to the above figures, the spreading unit according to the invention, generally designated by the reference numeral 1, comprises in a per se known manner a structure 2 which forms an elongated spreading chamber 3 arranged so that its longitudinal axis is horizontal and provided, at its longitudinal ends, respectively with a first opening 4, connected to a feed duct 5 for the hosiery item 6 to be spread, and with a second opening 7, connected to a suction duct 8, which can be connected to suction means.

The chamber 3 is closed in a downward region by a door 9 which can be opened on command to remove the spread hosiery item 6 by gravity.

Means for gripping the hosiery item 6, generally designated by the reference numeral 10, are also arranged in the spreading chamber 3.

According to the invention, the spreading unit comprises an auxiliary duct 11, connecting the feed duct 5 to the suction duct 8, and valve means, which can be actuated on command so as to produce a stream of air through the spreading chamber 3 in one direction, so as to convey the hosiery item 6 to be spread into the spreading chamber 3, and then a stream of air in the opposite direction along said spreading chamber 3, so as to spread the hosiery item 6, retained by the gripping means 10, simply by using the suction along the suction duct 8.

More particularly, the structure 2 forms a first compartment 12, which is arranged proximate to the first opening 4 and connects the feed duct 5 to the auxiliary duct 11. In practice, the first compartment 12 is provided with a port 13 connected to the auxiliary duct 11 and crossed by the feed duct 5, which is connected to the first opening 4. The portion of the feed duct 5 lying inside the compartment 12 is conveniently perforated so as to connect the first compartment 12 to the inside of the duct 5.

Proximate to the second opening 7 a second compartment 14 is provided, having: a first port 15, connected to the first opening 7 by means of a tubular segment 16; a second port 17, connected to the outside by means of a grille 18; and a third port 19, connected to a third compartment 20.

The third compartment 20 has in turn : a first port 21, connected to a fourth compartment 22; a second port 23, connected to the auxiliary duct 11; and a third port 24, in practice coinciding with the third port 19 of the second compartment 14.

The fourth compartment 22 is in turn provided with: a first port 25, connected to the suction duct 8; a second port 26, connected to the outside by means of a grille 27; and a third port 28, in practice coinciding with the first port 21 of the third compartment.

The valve means comprise a first gate 29 arranged on the feed duct 5 and slideable within a seat 30 formed in the portion of the structure 2 that delimits the first compartment 12. In practice, the gate 29 is constituted simply by a plate provided with a hole 31; through the sliding of said plate at right angles to the axis of the feed duct 5, the plate can be moved at said feed duct 5, so as to keep it open, or can be offset with respect to the feed duct 5, so as to close it.

Figure 6:
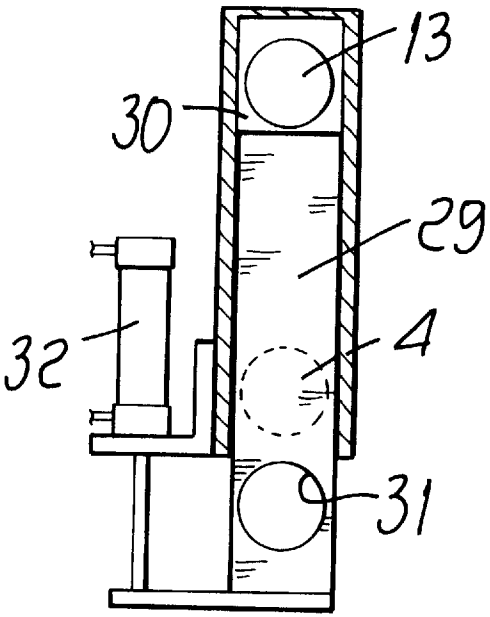
FIG. 6 is a schematic sectional view of FIG. 2, taken along the plane VI—VI.
Figure 5:
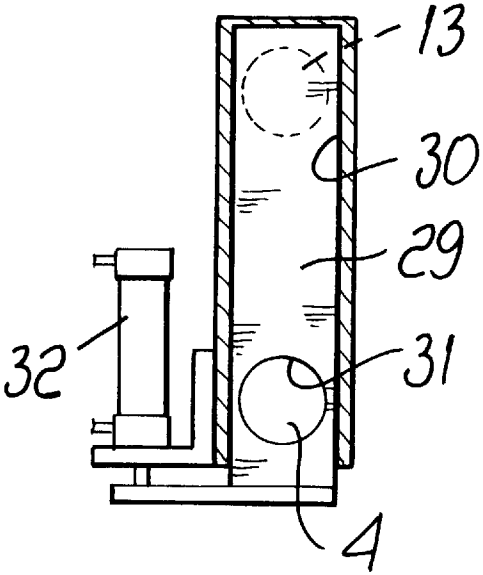
FIG. 5 is a schematic sectional view of FIG. 1, taken along the plane V—V.
Figure 4:
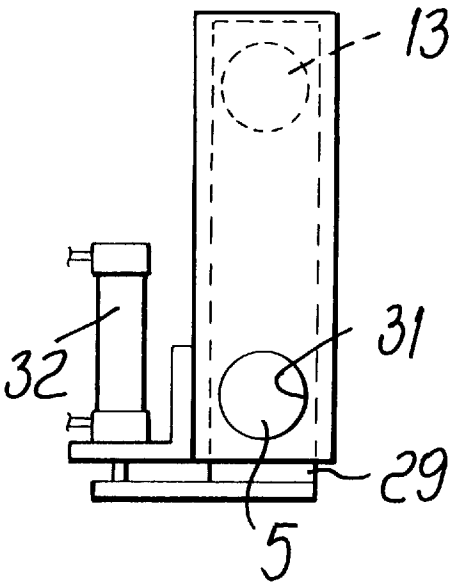
FIG. 4 is a schematic sectional view of FIG. 1, taken along the plane IV—IV.

The first gate 29 can be actuated, as shown in particular in FIGS. 4 to 6, by a fluid-actuated cylinder 32, preferably a pneumatic cylinder.

The valve means also comprise a second gate 33, which is also simply constituted by a sliding plate arranged in the region connecting the second compartment 14 to the third compartment 20 and the third compartment 20 to the auxiliary duct 11.

Figure 10:
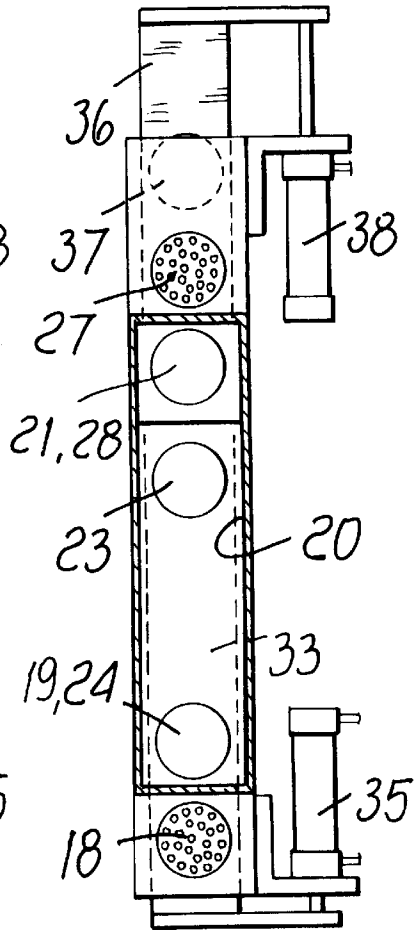
FIG. 10 is a schematic sectional view of FIG. 1, taken along the plane X—X.
Figure 9:
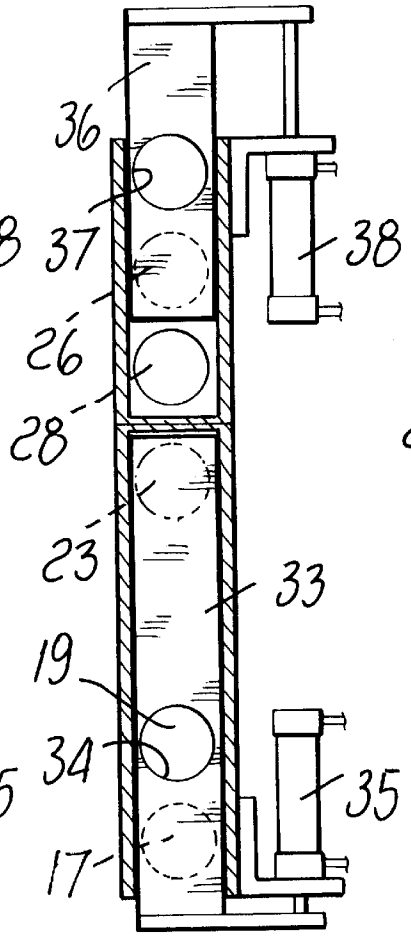
FIG. 9 is a schematic sectional view of FIG. 1, taken along the plane IX—IX.
Figure 8:
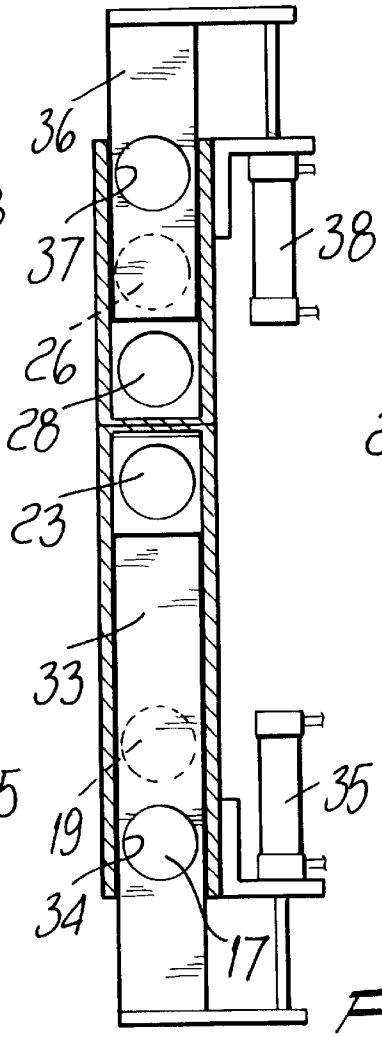
FIG. 8 is a schematic sectional view of FIG. 2, taken along the plane VIII—VIII.
Figure 7:
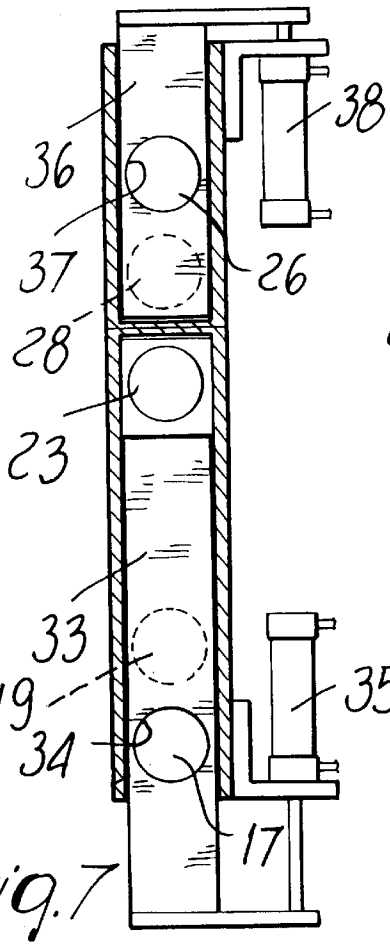
FIG. 7 is a schematic sectional view of FIG. 3, taken along the plane VII—VII.

More particularly, the second port 17 of the second compartment 14, the third port 19 of said compartment 14, and the second port 23 of the third compartment 20 are located side by side and are arranged so that their axes lie transversely with respect to a same plane constituted by the plane of arrangement of the gate 33. The gate 33 has a hole 34 which, as a consequence of the movement of said gate 33 transversely to the axes of said ports, can be placed at the port 17 in order to connect the second compartment 14 to the outside, as shown in FIGS. 2, 3, 7, and 8, simultaneously opening the port 23 that connects the auxiliary duct 11 to the third compartment 20, or at the third port 19 of the second compartment 14, as shown in FIGS. 1, 9, and 10, in order to connect the second compartment 14 to the third compartment 20, simultaneously closing the second port 23 of the third compartment 20.

The second gate 33 can also be actuated simply by means of a fluid-actuated cylinder 35, for example a pneumatic cylinder, as shown in particular in FIGS. 7 to 10.

The valve means also comprise a third gate 36 opening and closing the second port 26 and the third port 28 of the fourth compartment 22. The third gate 36, too, can be simply constituted by a plate which is slideable at right angles to the axes of the ports 26 and 28 and is provided with a hole 37 which can be arranged, through the sliding of the gate 36, at the second port 26 in order to connect the fourth compartment 22 to the outside, simultaneously closing the third compartment 28, or at the third port 28, closing the second port 26.

The third gate 36, too, can be simply actuated by means of a fluid-actuated cylinder 38, preferably constituted by a pneumatic cylinder, as shown in particular in FIGS. 7 to 10.

Advantageously, proximate to the first opening 4, in the spreading chamber 3 a perforated flap 39 is oscillatably provided, about an axis 40 which is horizontal and perpendicular to the longitudinal axis of the spreading chamber 3, so as to close the first opening 4 partially or open it completely, as will become apparent hereinafter.

The means for gripping the hosiery item 6 comprise a presser element 41, located proximate to the second opening 7 and facing the door 9. The presser element 41 can be actuated, in a per se known manner, for example by means of a pneumatic cylinder 42, so as to clamp the first end of the hosiery item 6 that enters the spreading chamber 3 against the door 9. Moreover, proximate to the presser element 41, an inclined wall 43 is fixed to the side walls that delimit the spreading chamber 3 and forms a passage for the hosiery item 6 which tapers from the first opening 4 towards the second opening 7, so as to reliably position the first end of the hosiery item 6 that enters the spreading chamber 3 below the presser element 41, which is arranged almost at the end of said passage.

The door 9 is pivoted to the structure 2 about a substantially horizontal axis that is parallel to the longitudinal axis of the spreading chamber 3, and the opening and closing movements whereof can be actuated, in a per se known manner, by means of pneumatic actuators or by means of mechanical actuators which are not shown for the sake of simplicity.

The spreading unit according to the invention also comprises means for sensing the presence of a hosiery item 6 inside the spreading chamber 3. Said sensor means can be constituted by a photocell 44 laterally facing the spreading chamber 3, and the walls that delimit the spreading chamber 3, at least at the photocell 44, are made of a transparent material.

Operation of the spreading unit according to the invention is as follows.

In a first operating position of the valve means, shown in FIG. 1, the first gate 29 opens the feed duct 5, connecting it to the first opening 4, whilst the second gate 33 closes the second port 17 of the second compartment 14 and the second port 23 of the third compartment 20, simultaneously opening the third port 19 of the second compartment 14. In this operating position, the third gate 36 opens the third port 28 of the fourth compartment 22 and closes the second port 26 of said compartment 22. In this operating position, the suction duct 8 is connected, through the fourth compartment 22, the ports 28 and 21, the third compartment 20, the ports 24 and 19, and the second compartment 14, to the second opening 7 and therefore to the feed duct 5 through the spreading chamber 3, whilst the auxiliary duct 11 is closed. As a consequence of this fact, the stream of air generated by the suction along the duct 8 conveys a hosiery item 6 to be spread into the spreading chamber 3, moving one of its ends below the presser element 41; as soon as the photocell 44 detects the arrival of the hosiery item, said presser element is actuated so as to clamp the end of said hosiery item against the door 9, which is in its closed position.

Figure 2:
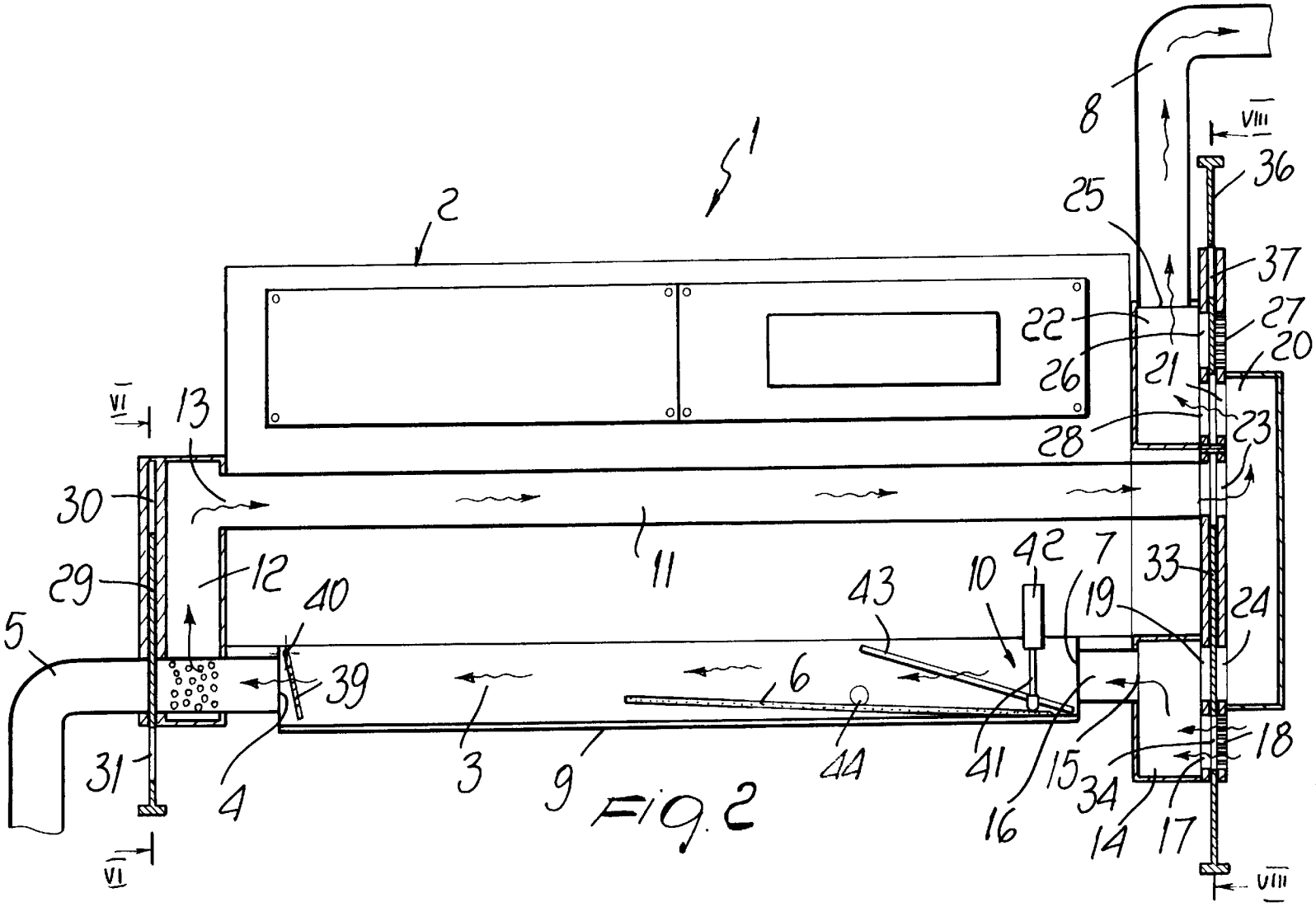
FIG. 2 is a schematic sectional view of the device according to the present invention, with the valve means in the second operating position.

At this point, the valve means are moved to a second operating position, illustrated in FIG. 2, wherein the first gate 29 closes the feed duct 5, whilst the second gate 33 connects the second compartment 14 and therefore the second opening 7 to the outside and connects the auxiliary duct 11 to the third compartment 20 while interrupting the connection of the second compartment 14 to the third chamber 20. In this operating position, the third gate 36 is kept in the previous position. In this manner, the suction duct 8 is connected to the spreading chamber 3 on the side of the first opening 4, whilst the second opening 7 is connected to the outside. As a consequence of this fact, inside the spreading chamber 3 a stream of air is provided, the direction whereof is opposite to the direction it had during the first operating step and therefore the hosiery item 6 is spread out. It should be noted that during this step the perforated flap 39 closes, because of the air stream onto the first opening 4, preventing the hosiery item 6 from being drawn out of the spreading chamber 3 if the grip of the presser element 41 is imperfect; the air stream is in any case not interrupted, since, as mentioned, the flap 39 is perforated.

Figure 3:
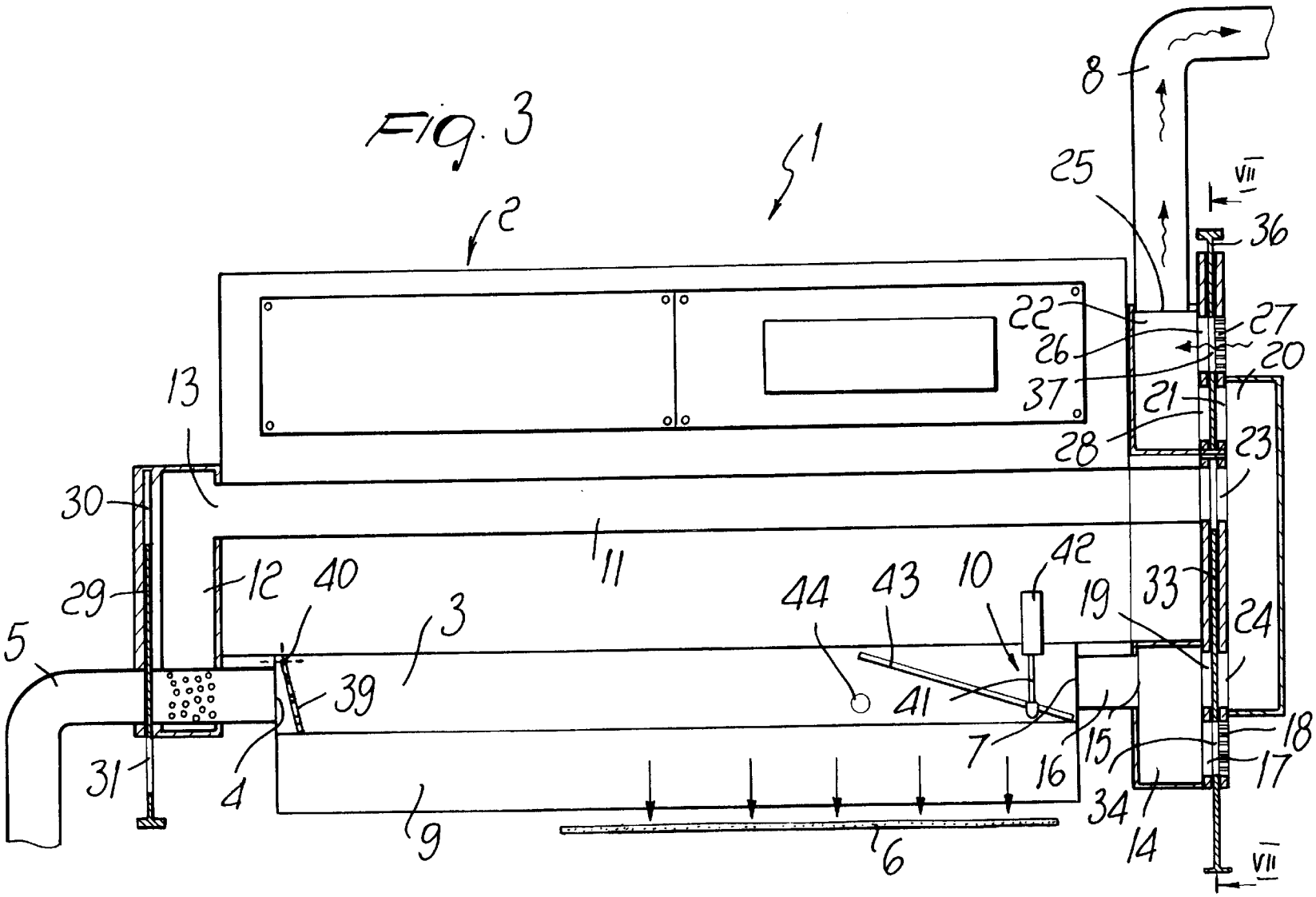
FIG. 3 is a schematic sectional view of the device according to the present invention, with the valve means in the third operating position.

Once correct spreading of the hosiery item 6 has been achieved, the third gate 36 is actuated so as to connect the suction duct 8 to the outside and so as to close the connection of the fourth compartment 22 to the third compartment 20, as shown in FIG. 3. In this manner, the suction along the duct 8 is cut off from the spreading chamber 3, wherein the door 9 is opened in order to remove the spread hosiery item by gravity.

At this point, the gates 29, 33, and 36 are returned to the position shown in FIG. 1 so as to draw into the spreading chamber 3 a new hosiery item 6 to be spread.

In practice, as explained above, the spreading unit according to the invention can operate correctly by simply connecting its suction duct 8 to a centralized suction system, without having to provide an independent fan and motor.

In practice it has been observed that the spreading unit according to the invention, since it can operate correctly even with centralized suction systems, fully achieves the intended aim, allowing a significant saving in terms of investments in hosiery factories having centralized suction systems and requiring a plurality of spreading units.

The spreading unit thus conceived is susceptible of numerous modifications and variations, all of which are within the scope of the inventive concept; all the details may also be replaced with other technically equivalent elements.

In practice, the materials employed, as well as the dimensions, may be any according to requirements and the state of the art.

What is claimed is:

1. A hosiery item spreading unit with pneumatic feed, usable with pneumatic hosiery item conveyance systems equipped with a centralized suction, comprising: a structure forming an elongated spreading chamber, said chamber being arranged with a longitudinal axis thereof being substantially horizontal; a first opening provided at a first longitudinal end of the chamber; a duct for feeding a hosiery item to be spread, said duct being connected to said first opening; a second opening provided at a second longitudinal end of said chamber; a suction duct connected to said second opening; and suction means connected to said suction duct; a door which can be opened on command to remove the spread hosiery item, said door closing said spreading chamber in a downward region thereof; gripping means for gripping a longitudinal end of the hosiery item being contained in said spreading chamber, said gripping means being spaced from said first opening towards said second opening; an auxiliary duct connecting said hosiery item feed duct to said suction duct; and valve means being actuatable on command selectively into a first operating position, wherein the valve means close said auxiliary duct, connecting said suction duct to said feed duct through said spreading chamber for conveying a hosiery item to be spread into the spreading chamber, into a second operating position, wherein the valve means connect said suction duct to said feed duct through said auxiliary duct and connect said second opening with outside environment to reverse suction stream through said spreading chamber with respect to suction stream determined by said first operating position and into a third operating position, wherein the valve means disconnect said spreading chamber from said suction duct.

2. A spreading unit according to claim 1, wherein said valve means, in said third operating position, connect said suction duct to the outside environment.

3. A spreading unit according to claim 1, wherein said valve means, in said third operating position, close said auxiliary duct and connect said second opening to the outside environment.

4. A spreading unit according to claim 1, comprising a first compartment arranged proximate to said first opening and connecting said feed duct to said auxiliary duct.

5. A spreading unit according to claim 4, comprising a second compartment having a first and a second port; and a third compartment having a third port, said second compartment being connected to said second opening through said first port, to the outside environment through said second port, and to the third compartment through said third port, said third compartment connecting said second compartment to said suction duct.

6. A spreading unit according to claim 5, wherein said third compartment is provided with first, second and third ports, and is connected to said suction duct through said first port, to said auxiliary duct through said second port, and to said second compartment through said third port coinciding with the third port of said second compartment.

7. A spreading unit according to claim 5, wherein said feed duct has a portion having perforations for connecting said second compartment to said feed duct, said portion with perforations passing through said first compartment.

8. A spreading unit according to claim 5, wherein said valve means comprise a first gate, said first gate being actuatable on command and arranged on said feed duct proximate to said first compartment.

9. A spreading unit according to claim 5, wherein said second port of the second compartment, said third port of the second compartment, and said second port of the third compartment are located side by side and are arranged so that axes thereof lie transversely with respect to a same plane, said valve means further comprising a second gate which is actuatable on command and is slideable along said plane in order to close said second port of the second compartment and said second port of the third compartment, and simultaneously to open said third port of the second compartment in said first operating position of the valve means, in order to open said second port of the second compartment and said second port of the third compartment, simultaneously closing said third port of the second compartment in said second operating position of the valve means and in said third operating position of the valve means.

10. A spreading unit according to claim 9, comprising a fourth compartment provided with: a first port, connected to said suction duct; a second port, connected to the outside; and a third port, connected to said first port of the third compartment; said valve means comprising a third gate which is arranged on said second and third ports of the fourth compartment and is actuatable on command in order to close said second port and open said third port in said first operating position of the valve means and in said second operating position of the valve means and in order to close said third port and open said second port in said third operating position of the valve means.

11. A spreading unit according to claim 10, comprising pneumatic cylinders for the actuation of said gates.

12. A spreading unit according to claim 9, comprising a perforated flap being arranged on said first opening, in said spreading chamber, and said flap being oscillatable under effect of suction stream through said spreading chamber from an open position to a closed position wherein the flap partially closes said first opening, allowing flow of air when said valve means are in said second operating position.

13. A spreading unit according to claim 1, further comprising an inclined wall fixed to side walls of said spreading chamber so as to form a positioning passage for said longitudinal end of the hosiery item drawn into said spreading chamber, said passage gradually tapering from said first opening towards said second opening, and wherein said gripping means for gripping an end of the hosiery item comprises a presser element, said presser element facing said door, said door having an upper face cooperating proximate to said presser element with said inclined wall.

14. A spreading unit according to claim 13, comprising means for sensing the presence of a hosiery item in said spreading chamber.

15. A spreading unit according to claim 14, wherein said sensor means comprises a photocell, said photocell laterally facing said spreading chamber in a region thereof, and said spreading chamber being delimited by transparent walls at least in said region where said photocell is located.

* * * * *